United States Patent [19]

Swenson

[11] 4,246,671

[45] Jan. 27, 1981

[54] BUOY ANCHORING SYSTEM

[75] Inventor: Richard C. Swenson, Carriere, Miss.

[73] Assignee: The United States of America as represented by the Secretary of the Navy, Washington, D.C.

[21] Appl. No.: 96,708

[22] Filed: Nov. 21, 1979

[51] Int. Cl.[3] ..... B63B 21/52

[52] U.S. Cl. ..... 9/8 R; 242/85.1

[58] Field of Search ..... 9/8 R, 9; 114/295, 210, 114/294; 188/65.4; 242/128, 85.1

[56] References Cited

U.S. PATENT DOCUMENTS

| | | | |
|---|---|---|---|
| 2,722,018 | 11/1955 | Mueller | 9/8 R |
| 3,035,285 | 5/1962 | Squires, Jr. | 9/9 |
| 3,054,123 | 9/1962 | Moeller | 9/9 |
| 3,187,705 | 6/1965 | Costello et al. | 114/294 |
| 3,336,892 | 8/1967 | Barry et al. | 114/294 |
| 3,351,158 | 11/1967 | Kite | 188/65.4 |
| 3,471,877 | 10/1969 | Bayles | 9/8 R |
| 3,487,485 | 1/1970 | Holm et al. | 9/8 R |

*Primary Examiner*—Trygve M. Blix
*Assistant Examiner*—Jesús D. Sotelo
*Attorney, Agent, or Firm*—Richard S. Sciascia; Harvey A. David

[57] ABSTRACT

A buoy anchoring system includes an anchor device in the form of a weighted cannister that pays out line from the center of a fixed, hollow-cored bale during free fall. The line is secured against further pay out after the device impacts the bottom by wrapping about a shaft that is driven upwardly within the bale by the impact. The shaft has a line engaging cross-bar at its upper end, and is held in an extended position prior to impact by a shear pin.

11 Claims, 3 Drawing Figures

BUOY ANCHORING SYSTEM

BACKGROUND OF THE INVENTION

This invention relates to buoy anchoring systems, and more particularly to improvements in such systems of the type wherein a mooring line is payed out as the anchoring device descends and is automatically secured at the proper length when the anchor device comes to rest on the bottom.

The advantages and uses of systems of this type are well known and include primarily the ability to establish a marker buoy having a reasonably small watch circle even though anchored in relatively deep water, and without having to have prior knowledge of the actual depth of the water in order to predetermine the length of mooring line.

A variety of anchoring systems of the mentioned typed have been devised in the past and have employed a brake or jamming means to snub or arrest the payout of mooring line from a reel or a coiled supply carried by the anchor device. Those systems have typically used reel locks, brakes, line jamming jaw means, or line snubbing shafts around which line from a fixed coil is caused to take a plurality of turns so as to frictionally resist further payout.

Of the foregoing, those devices that rely on the friction of a plurality of turns of line about a shaft or core to halt line payout from a fixed coil that is coaxial with the shaft are considered to be the least likely to cause line breakage or damage. U.S. Pat. Nos. 3,336,892 to G. J. Barry et al and 3,351,158 to P. E. Kite disclose line payout arresting mechanisms using that principle. In the Barry et al device, as the line pays off the fixed coil, it passes through an aperture in a rotary member mounted on the end of the shaft. A solenoid or spring driven pin is provided to halt rotation of the rotary member, thereby causing the line to wrap the shaft and terminate payout. It is evident that any hockle in the line or binding of the rotary member will result in premature termination of the line payout. The required interactions of a plurality of mechanical and/or electrical parts during actuation to terminate payout increases likelihood of failure of the device to function properly at the required time. The Kite disclosure reveals a similarly complex device wherein actuation of a number of coacting mechanical elements, including pivoting of an arm at the end of the shaft by a spring, are required to result in proper operation of the device. Of course, the complexity of each of these devices renders them expensive to fabricate and maintain. Maintenance prior to use, is of course, an important factor in buoy anchoring systems of the type concerned which may remain stored for substantial periods under conditions in which rust, corrosion, and dampness tend to attack various, mechanical, electrical and pyrotechnic components, rendering them liable to failure.

With the foregoing in mind, it is a principal object of this invention to provide an improved buoy anchoring system having automatic termincation of line payout.

Another object of this invention is the provision of a buoy anchoring device having an unusually high degree of reliability.

Still another object is to provide an improved anchoring and automatic mooring line securing device that does not subject the line to the pinching, jamming, or chaffing common to some prior art anchoring devices, and avoids the shortcomings attendant the unnecessarily complicated structure of other such devices.

As another object, the invention aims to provide an anchoring apparatus that is noteably more economical to manufacture than its predecessors, and which can be stored for great lengths of time under severe conditions of temperature and humidity without degrading the reliability thereof.

Other objects and many of the attendant advantages will be readily appreciated as the subject invention becomes better understood by reference to the following detailed description, when considered in conjunction with the accompanying drawings.

DESCRIPTION OF THE PREFERRED EMBODIMENT

Figure 1:
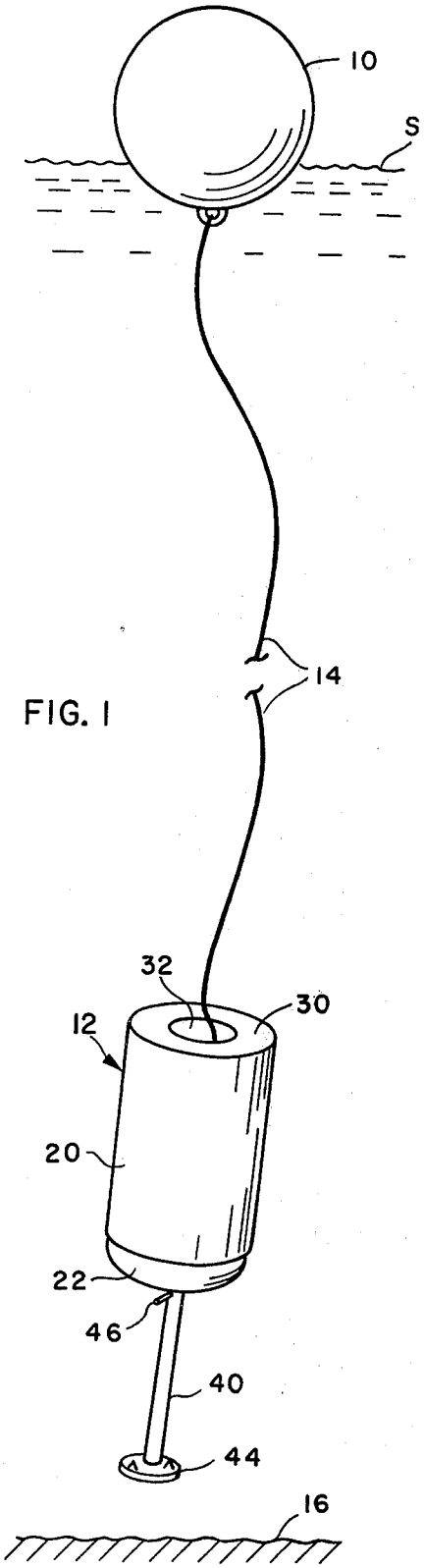
FIG. 1 is a perspective view of a buoy anchoring system including a line payout and anchoring device embodying the invention.

Referring first to FIG. 1, a buoy 10 illustrated in the process of being anchored in a body of water of indeterminate depth. The buoy 10 floats at the surface S of the water as an anchoring device 12, connected to the buoy by a mooring cable or line 14, plummets toward the floor or bottom 16, paying out mooring line as it falls.

Figure 2:
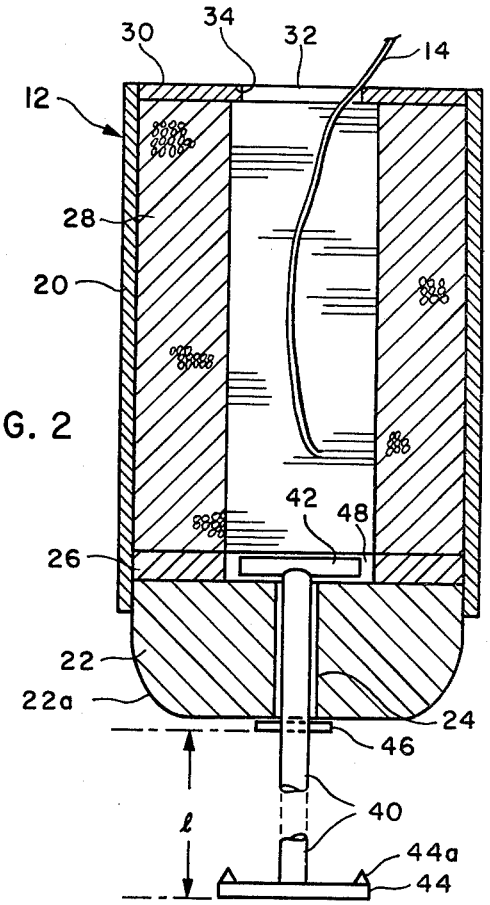
FIG. 2 is a vertical sectional view of the anchoring device of FIG. 1.

Referring additionally now to FIG. 2, the anchoring device 12 comprises a body in the form of a cylindrical cannister 20. Fixed in the lower end of the cannister 20 is a lead weight 22 having a projecting portion presenting a rounded or curved surface 22*a*. The weight 22, is further provided with a central bore 24 that is coaxial with the cylindrical cannister 20.

Housed within the cannister 20, and spaced from the upper surface of the weight 24 by an annular spacer or ring 26, is a stationary coil or bale 28 of the mooring line 14.

The bale 28 is of cylindrical configuration so as to snugly fit into the cannister 20, and is wound so as to be open-cored or hollow as shown. The mooring cable or line 14, of which the bale is wound, may be formed of any suitable material and may include both electrical conductors and strength members for certain applications. If the cable used must have a synthetic fiber strength member for weight reduction, enough elongation capability with good fatigue life to accommodate surface wave action must be provided. In shallow water, polyester is a good choice. In deep water, however, aramid synthetic fiber appears to be the better choice. The high strength, excellent fatigue resistance, and small elongation under load provide the necessary properties for long tension members.

The cable or line 14 is pre-twisted during winding of the bale to prevent a helix from forming as the line is pulled from the center thereof during deployment. As the line wound to form the bale it is coated with a matrix material such as depolymerized rubber. This ensures a constant payout resistance force and avoids any advance payout that would cause snarling.

A lid or top 30 is fixed to the cannister 20 at the upper end thereof in confining relation to the bale 28 of mooring line. The top 30 is provided with a central opening 32 through which the mooring line 14 can be drawn from the innermost layer of the bale 28. The opening 32, of course, is provided with a smooth edge 34 to assure sliding of the mooring line thereover without damage.

Mounted in the central bore 24 of the lead weight 22 is a line locking shaft 40. At the upper end of this shaft is a radially extending, rigid arm means in the form of a cross-bar 42 that limits downward movement of the shaft 40, and also cooperates with the shaft in effecting a line securing function upon impact of the anchor device 30 with the bottom 16. The shaft 40 extends below the lead weight 22 for a distance l that is substantially equal to, or slightly less than the length of the bale 28. At the bottom end of the shaft 40 is provided an impact pad 44, conveniently in the form of a disc welded to the shaft, which serves to minimize penetration of the shaft 40 into the bottom, and also prevents rotation of the shaft after impact as will later be discussed.

The shaft 40 is normally held in an extended position by a shear pin 46 just below the lead weight 22. In that extended position the cross-bar 42 is located in the recess defined by the central opening of the spacer ring 26 so as to be below the bottom of the bale 28. It will be recognized that the recess could be defined in the upper surface of the lead weight 22, and the spacer ring 26 omitted.

Upon deployment of the anchor device 12, as by rolling over the side of a ship in the case of large units, the device plummets downwardly with the shaft 40 and pad 44 aimed toward the bottom. The mooring line 14, having its bitter end secured to a buoy 10, for example, is payed out smoothly from the bale 28 through opening 32 of the cannister lid. Because the bale 28 is stationary or fixed relative to the cannister, the point of departure of the line from the bale revolves around the central axis of the device.

Figure 3:
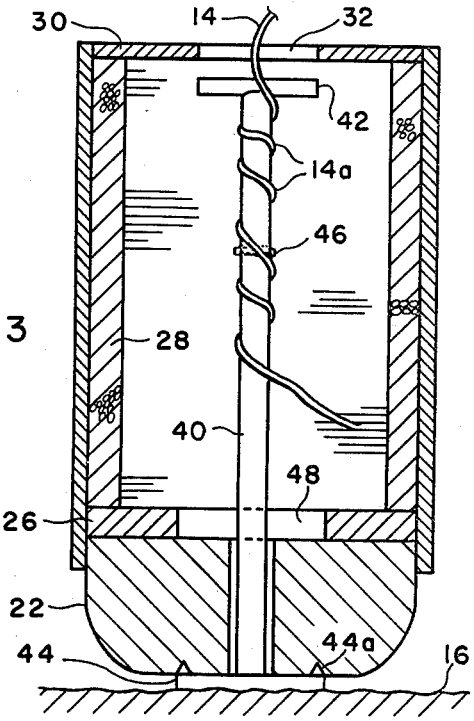
FIG. 3 is a view similar to that of FIG. 2 but with parts in different operative positions.

When the pad 44 impacts upon the bottom 16, the momentum of the cannister 20 and the weight 22 cause the pin 46 to be sheared and the shaft 40 to be driven inwardly of the device 12 to the position illustrated in FIG. 3. That movement brings the cross-bar 42 into a position diametrically crossing the opening 32 in the cannister lid 30, thereby effectively preventing the standing portion of the line 14 from revolving about the shaft 40. Because of that condition and the fact that the bale 28 remains fixed relative to the shaft 40, the line 14 being pulled from the innermost layer of the bale will wrap about the shaft 40 until the turns 14*a* thereabout produce sufficient friction to prevent further pay-out. While rotation of the shaft 40 is generally precluded by the frictional engagement of the pad 44 with the weight 22, which engagement increases with increasing forces on line 14, the addition of one or more projections or tooth means 44*a* may be provided on the upper surface of the pad 44, or on the sides of the shaft 40, so as to bite into the lead weight and effect a more positive fixation of the shaft against rotation.

From the foregoing detailed description it will be recognized that the present invention has met the aforementioned objects and advantages, and in particular has provided a particularly reliable anchor device with a line pay-out arresting mechanism of the shaft wrapping type.

Obviously, other embodiments and modifications of the subject invention will readily come to the mind of one skilled in the art having the benefit of the teachings presented in the foregoing description and the drawing. It is, therefore, to be understood that this invention is not to be limited thereto and that said modifications and embodiments are intended to be included within the scope of the appended claims.

What is claimed is:

1. An anchor device of the type wherein mooring line is payed out as the device falls through a body of water and automatically secures the line against further pay-out upon impact with the floor of the body of water, said device comprising:

a cannister having top and bottom ends, a weight member at the bottom end of said cannister, and closure means at the top end of said cannister, said closure means having a central opening therein;

a wound bale of mooring line confined in said cannister, said bale having top and bottom ends and characterized by a hollow core in registration with said opening whereby said mooring line can be withdrawn through said opening from the inner layer of said bale;

a shaft extending through the bottom end of said cannister and projecting downwardly therefrom a distance substantially equal to the length of said bale between the top and bottom ends thereof, the upper end of said shaft being disposed adjacent the bottom end of said bale;

arm means extending radially from said upper end of said shaft; and retainer means cooperable between said shaft and said cannister for holding said shaft against movement inwardly of said cannister while said device falls through said body of water, said retainer means being yieldable upon said impact to permit said shaft to move inwardly of said cannister into the hollow core of said bale so as to shift said arm means to a position adjacent the top ends of said bale and cannister, whereby said line will engage said arm means and wrap around said shaft with sufficient turns to frictionally secure said line.

2. An anchor device as defined in claim 1, and wherein:

said cannister is cylindrical, said shaft is coaxial with said cannister, and said weight member presents spherically curved surfaces for promoting fall of said device with said axis vertical.

3. An anchor device as defined in claim 2, and wherein:

said weight member has a central bore aligned with said axis; and said shaft extends through said bore.

4. An anchor device as defined in claim 3, and wherein:

said arm means comprises a cross-bar rigidly fixed to the upper end of said shaft.

5. An anchor device as defined in claim 3, and wherein:

said retainer means comprises a shear pin extending from said shaft and adapted to be sheared by said weight member upon occurrence of said impact.

6. An anchor device as defined in claim 3, and further comprising:

a pad member fixed to the lower end of said shaft, said pad member being adapted to engage said floor and to resist penetration thereof by said shaft.

7. An anchor device as defined in claim 6 and further comprising:

means cooperable with said weight member for preventing rotation of said shaft after inward movement thereof by said impact.

8. An anchor device as defined in claim 7, and wherein:

said arm means comprises a cross-bar rigidly fixed to the upper end of said shaft; and said retainer means comprises a shear pin extending from said shaft and adapted to be sheared by said weight member upon impact of said device with said floor.

9. An anchor device comprising:

a cannister having a cylindrical wall, a closure member fixed at one end and having a central opening, and a weight member fixed at the other end and having a central bore, said weight member projecting beyond said cylindrical wall, and presenting curved surfaces, whereby said cannister is adapted to fall through a body of water with said weight member pointing down and the central axis of said cannister substantial vertical;

a wound hollow-cored bale of mooring line confined in said cannister with its hollow core in registration with said central opening, whereby line can be payed out from the inner layers of said bale through said opening;

a line locking shaft disposed in and extending from the interior of said cannister, through said weight member, and projecting exteriorly of said cannister beyond said weight member for a predetermined length;

a cross-bar fixed at the inner end of said shaft;

retainer means yieldably retaining said shaft in an extended position with said cross-bar disposed adjacent the end of said bale remote from said opening;

an impact pad fixed at the outer end of said shaft whereby upon impact of said anchor means with the floor of a body of water said retainer means will yield to relative movement between said cannister and said shaft to shift said shaft inwardly of said bale and position said cross-bar adjacent and transversely of said opening.

10. An anchor device as defined in claim 1 and wherein:

said bale comprises a matrix material coated on said line during winding thereof, said matrix material providing a predetermined resistance to pay out of said line.

11. An anchor device as defined in claim 10, and wherein:

said retainer means comprises a shear pin extending from said shaft and engaging said weight member.

* * * * *